US009708675B1

(12) United States Patent
Artola

(10) Patent No.: US 9,708,675 B1
(45) Date of Patent: Jul. 18, 2017

(54) METHOD OF TANNING AND WASHING LEATHER, CANVAS, COTTON AND ANY OTHER MATERIALS, AS WELL AS THE FINISHED PRODUCT

(71) Applicant: Jury Artola, Brooklyn, NY (US)

(72) Inventor: Jury Artola, Brooklyn, NY (US)

(73) Assignees: Jury Artola, Brooklyn, NY (US); Olga Grib, Brooklyn, NY (US)

( * ) Notice: Subject to any disclaimer, the term of this patent is extended or adjusted under 35 U.S.C. 154(b) by 147 days.

(21) Appl. No.: 14/800,386

(22) Filed: Jul. 15, 2015

(51) Int. Cl.
*C14C 3/10* (2006.01)

(52) U.S. Cl.
CPC ..... *C14C 3/10* (2013.01)

(58) Field of Classification Search
CPC ..... C14C 3/10
See application file for complete search history.

(56) References Cited

U.S. PATENT DOCUMENTS 8,679,196 B2 3/2014 Reineking et al.
2009/0269378 A1* 10/2009 Hueffer ..... B01D 39/00 424/402

* cited by examiner

*Primary Examiner* — Eisa Elhilo

(57) ABSTRACT

Present invention related to method of washing and finishing leather, canvas, cotton and any other material, as well as the finished products such as, but not limited to shoes, bags, accessories, clothing, denim, T-Shirts, and components of these products by washing in brewed coffee.
Material, for example leather, canvas, cotton, denim, washed in coffee before manufacturing the product.

11 Claims, No Drawings

METHOD OF TANNING AND WASHING LEATHER, CANVAS, COTTON AND ANY OTHER MATERIALS, AS WELL AS THE FINISHED PRODUCT

This application is the United States Nonprovisional application claims priority from U.S. Provisional Application 62/025,064 filed, Jul. 16, 2014, the entire disclosure of which is incorporated herein by reference.

The present invention relates to a process for finishing leather and other products

BACKGROUND OF THE INVENTION

In the production of leather and other materials, the tanning and finishing process is of decisive importance for the properties and quality of the resulting leather, material, or finished product's overall appearance and scent. Among the various finishes known in the art, i.e. dressings, shoe creams and shoe polishes, deep-stained antiques, deep stained micro-teeks is a conventional and widely spread way of finishing which is readily available on the industrial scale on most various kinds of skins and hides, and provides tanned leathers with satisfactory properties. (U.S. Pat. No. 8,679,196)

SUMMARY OF INVENTION

Chrome-based tanning agents and tanning finishing agents are however considered synthetic and environmentally unfriendly and it is therefore desired to provide another finishing method. U.S. Pat. No. 8,679,196 describes another method of tanning. But this method is very complicated.

Accordingly, it is an object of the present invention to overcome, or at least alleviate, one or more of the difficulties related to the prior art.

Accordingly, in a first aspect of the present invention, there is provided a process for the preparation of tanned leather, which process includes preparing a coffee-finishing compound, tanning, draining off, inspecting for color saturation and consistency and tumbling to soften the leather.

The coffee-finishing compound comprises an instant coffee by diluting the instant coffee in water wherein the coffee solution diluted to 110-120 g of the instant coffee per 1 L of water.

Drumming the product for 120-180 minutes at 15-27 degrees C. Leather Hides are tumbled for 60 minutes to achieve a small grain texture and up to 180 minutes for a larger grain texture In another aspect of the present invention the coffee-finishing compound comprises boiling whole coffee beans in water.

The coffee-finishing compound comprises boiling whole coffee beans in water between 1 and 5 minutes, 10 and 15 minutes, and even more preferably between 20 to 30 minutes above 100 C to achieve the specific intensity and permeation of the compound.

In another aspect of the present invention the coffee-finishing compound comprises re-using by-product of already brewed coffee grains.

The present invention relates to the finishing process, the defined finishing compositions, the use of the finishing agent and its compositions, the tanned leather, skin, pelt, fabric, canvas, cotton, denim and finished products—such as shoes, bags, accessories, clothing, denim, T-Shirts, etc.

According to the present invention it has now surprisingly been found that using coffee as a finishing agent of outstanding quality can be achieved using brewed coffee in the below outlined parameters—in particular even as complete tanning material—and finishing methods.

BEST MODE FOR CARRYING OUT THE INVENTION

When the brewed coffee compound is used in an organic medium, its concentration preferably high. It yields a unique, natural and environmentally friendly finish with a distinct color, texture and scent The coffee-finishing compound may be achieved in the following ways:

Example 1

Using instant coffee by diluting it in water, in measured quantities to achieve desired saturation and result.

Tanning

Coffee washing and tanning process takes place in a wooden tanning drum. Bovine wet white or wet blue hide, fleshed and split to 1.4-1.6 mm is charged into a drum at 100% of coffee solution diluted to 110-120 g of instant coffee per 1 L of water and drummed for 120-180 minutes at 15-27 degrees C. Then the drum is drained, and the coffee solution is preserved for future tanning.

The leather hides, which are now tanned with the desired coffee stain, are then placed on racks to dry.

Once the leather is dried, it is inspected for color saturation and consistency. Since coffee tanning is a natural process, some color variation is expected, however in extreme variations, the hide could be refinished by hand, applying a sponge dipped in the coffee solution at optimal ratio of 110-120 g of instant coffee per 1 liter of water, or by spraying the coffee solution directly on the skin to evenly saturate the tone. Once the desired saturation is achieved, the hides are placed back into the drum for tumbling, to soften the leather. The hides are tumbled for 60 minutes to achieve a small grain texture and up to 180 minutes for a larger grain texture. After the tumbling process the leather is ready for production of shoes, bags, accessories or leather garments.

Example 2

Boiling whole coffee beans in water preferably between 1 and 5 minutes, or more preferably between 10 and 15 minutes, and even more preferably between 20 to 30 minutes to achieve desired proportions of the penetration of the process of invention.

Example 3

Brewing ground coffee beans in boiled water preferably between 1 and 5 minutes, or more preferably between 10 and 15 minutes, and even more preferably between 20 to 30 minutes above 100 C to achieve the specific intensity and permeation of the compound.

Any whole coffee beans, ground or instant coffee, either regular or decaf, including a reuse of the by-product of already brewed coffee grounds, may be used for this process and may be directly metered into the tanning drum, if desired.

Example 4

Coffee washing of a finished, final product such as shoes, bags, accessories, or leather garments.

The product is stitched and finished using wet white or wet blue leather hide at 1.4-1.6 mm utilizing patterns and specifications of this particular product. Once the production is finished, it is loaded into a wooden drum with 100% of coffee solution diluted to 110-120 g of instant coffee per 1 L of water and drummed for 60-150 minutes at 15-27 degrees C. Then the drum is drained, and the coffee solution is preserved for future tanning.

The product, which is now tanned with the desired coffee stain, is then placed on racks to dry.

Once the product is dried, it is inspected for color saturation and consistency. Since coffee tanning is a natural process, some color variation is expected, however in extreme variations, the products could be refinished by hand, applying a sponge dipped in the coffee solution at optimal ratio of 110-120 g of instant coffee per 1 liter of water, or by spraying the coffee solution directly on the product to evenly saturate the tone. Once the desired saturation is achieved, the product is placed back into the drum for tumbling with rocks at 10% of the weight of the total product volume, to soften it and add a distressed, worn texture. The product is tumbled for 10-15 minutes to achieve the desired effect. After the tumbling process the product is considered finished.

Optimal Tanning Conditions

Coffee solution temperature range: 15 C-27 C

Concentration—Coffee to water ratio: 110 g-120 g of coffee for 1 L of water

Tanning/Washing time: 120-180 minutes

Coffee Solution Below Optimal Ratio

The color saturation of leather decreases proportionately with dilution of the optimal coffee solution concentration. See optimal tanning conditions. This results in lighter leather color and finish, and in even lower doses, will only slightly alter the appearance of the original skin.

Coffee Solution Above Optimal Ratio

The color saturation of leather increases proportionately with the increase of coffee to water ratio, eventually making the skin too dark.

Tanning/Washing temperature <15 C

Washing leather in coffee solution below 15 C, does not open pores of leather and penetrate into the skin to achieve the desired color.

Tanning/Washing temperature >27 C

Washing the leather in coffee solution above 27 C causes the leather pores to shrink, and makes the skin hard and brittle, essentially burning the hide.

As a substrate for the treatment with finishing agent in particular for tanning, there may be used any conventional animal hides, skins, pelts, and fabrics as are in general employed for tanning, e.g. hides from cow, calf or buffalo (e.g. also as split hides), skins from goat, sheep or pig, buckskins and pelts; but also other hides and skins e.g. from other mammals (foal, camel, lama, kangaroo, wallaroo, wallaby), reptiles (snakes, lizards), fishes (shark, huachinango) or birds (ostrich), woolled skins and fur skins, in addition to canvas, cotton, and other fabrics, as well as completed products such as but not limited to shoes, bags, jackets, jeans, t-shirts, accessories, and any other skins, leather's, fabrics and finished products etc. may be used in the process of the invention.

As a "step" in the tanning and finishing process according to the invention there is meant any tanning step in a tanning process in which the coffee compound acts on the non-tanned or not fully tanned substrate, pre-tanning, main tanning, or full or complete tanning (including also a combined tanning and finishing). The coffee compound can thus be employed for pre-tanning, for main tanning, or for full (i.e. complete) tanning or for both pre-tanning and main tanning, and for combined tanning. The use of the coffee compound as a full tanning agent or as both a pre-tanning agent and a main tanning agent is however the most relevant aspect of the invention.

The tanning process of the invention—which may be a one stage tanning, a full tanning, or a two stage tanning, a pre-tanning followed by a main tanning, or a combined tanning—can be carried out directly after bating and/or after finishing a complete product.

The tanning and finishing process of the invention is very simple and may be carried out in a relatively short time, in particular within about 1 to 24 hours, depending on the desired saturation of the product.

Tanning with coffee compound may be carried out as a full tanning, or as a pre-tanning before, which may be carried out with a vegetable tanned raw material or with a synthetic raw material. Where the tanning and finishing with the process of the invention is carried out as a main tanning subsequently to a vegetable pre-tanning or to a synthetic pre-tanning with coffee compound concentration adjusted to achieve desirable result and saturation level of the finished product The tanned leather, skins or pelts produced according to the invention, as described above, may be further treated in conventional way, may be drained, dried and mechanically treated as usual for storage and/or shipment.

According to another preferred feature of the invention, the substrates are first tanned in one or two stages with, and then optionally subjected to complementary tanning as a finished product made with the pre-tanned material using the coffee compound.

Re-tanning and/or finishing with coffee compound may be carried out after having rinsed, dried and optionally mechanically treated the tanned leather, skin or pelt e.g. in the tannery. In another aspect of the present invention the coffee-finishing compound comprises re-using by-product of already brewed coffee grains.

Finally, it is to be understood that various other modifications and/or alterations may be made without departing from the spirit of the present invention as outlined herein.

The invention claimed is:

1. A method for tanning and washing materials comprising the steps of:

preparing a coffee-finishing compound in a wooden tanning drum and charging the materials into the drum followed by the steps of tanning; draining off; inspecting for color saturation and consistency and tumbling to softer the materials, wherein said materials include leather, canvas, cotton, skin, pelt, fabric, denim and their finished products.

2. The method for tanning and washing materials, according to claim 1, wherein the coffee-finished compound comprising an instant coffee by diluting the instant coffee in water to form a coffee solution.

3. The method for tanning and washing materials according to claim 2 wherein the coffee solution diluted to 110-120 g of the instant coffee per IL of water.

4. The method for tanning and washing materials according to claim 1 further comprising drumming the materials for 120-180 minutes at 15-27 degrees C.

5. The method for tanning and washing materials according to claim 1 wherein the materials are tumbled for 60 minutes to achieve a small grain texture and up to 180 minutes for a larger grain texture.

6. The method for tanning and washing materials according to claim 1 wherein the coffee-finishing compound comprising boiling whole coffee beans in water.

7. The method for tanning and washing materials according to claim 1 wherein the coffee-finishing compound comprising boiling whole coffee beans in water between 5 and 30 minutes above 100 C to achieve the specific intensity and permeation of the compound.

8. The method for tanning and washing materials according to claim 7 wherein the coffee-finishing compound comprising boiling whole coffee beans in water between 5 and 15 minutes above 100 C to achieve lighter color variations.

9. The method for tanning and washing materials according to claim 7 wherein the coffee-finishing compound comprising boiling whole coffee beans in water between 15 and 30 minutes above 100 C as most preferable amount of time determines the intensity and saturation of color.

10. The method for tanning and washing materials according to claim 1 wherein the coffee-finishing compound comprising re-using by-product of brewed coffee grains.

11. The method for tanning and washing materials according to claim 1 wherein after inspecting for color saturation the coffee solution is sprayed directly on the materials to achieve a distinct color and/or aroma.

* * * * *